US006866411B1

(12) United States Patent
Stelzer et al.

(10) Patent No.: US 6,866,411 B1
(45) Date of Patent: Mar. 15, 2005

(54) MIXING METHOD AND APPARATUS

(75) Inventors: C Ekkehard Stelzer, Vorchdorf (AT); Axel Wittek, Ottenbüttel (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 136 days.

(21) Appl. No.: 10/182,382

(22) PCT Filed: Nov. 24, 2000

(86) PCT No.: PCT/EP00/11700

§ 371 (c)(1),
(2), (4) Date: Jul. 29, 2002

(87) PCT Pub. No.: WO01/56687

PCT Pub. Date: Aug. 9, 2001

(30) Foreign Application Priority Data

Jan. 31, 2000 (DE) ..... 100 04 104
May 31, 2000 (JP) ..... 2000-003701

(51) Int. Cl.[7] ..... B01F 7/16; B01F 15/02
(52) U.S. Cl. ..... 366/136; 366/314; 366/315
(58) Field of Search ..... 366/315, 316, 366/317, 136, 137, 314

(56) References Cited

U.S. PATENT DOCUMENTS 2,641,453 A 6/1953 Teale
3,640,475 A * 2/1972 Jung et al. ..... 241/55
3,744,763 A 7/1973 Schnoring et al.
4,096,587 A * 6/1978 Haller ..... 366/304
4,175,873 A 11/1979 Iwako et al.
4,176,972 A * 12/1979 Stiling ..... 366/317
5,071,257 A * 12/1991 Hasenpath et al. ..... 366/315
5,590,961 A * 1/1997 Rasmussen ..... 366/317
5,759,604 A * 6/1998 Bottlinger et al. ..... 366/304
6,402,359 B2 * 6/2002 Bahner et al. ..... 366/317

FOREIGN PATENT DOCUMENTS

| | | |
|---|---|---|
| DE | 639769 | 12/1936 |
| DE | 3611048 | 10/1987 |
| DE | 29608713 | 8/1996 |
| DE | 29608712 | 9/1996 |
| EP | 0036067 | 9/1981 |
| EP | 0760254 | 3/1997 |

* cited by examiner

*Primary Examiner*—Tony G. Soohoo
(74) *Attorney, Agent, or Firm*—Clark & Brody

(57) ABSTRACT

According to a new partial stream method, different reagents (I, II) may be mixed quickly and intensively, especially for the production of emulsions, in a dispersing apparatus (10) which has a rotor/stator system (40, 50) at a container (B) near the bottom. A hot initial product, e.g. containing wax, may be dispersed with a dosed partial stream (R I') of a cold carrier in a premixing chamber (60) via a feeding device (30, 38) below the rotor (50). The resulting mixture is then remixed with a cold main stream (R I) or a part hereof (R I") fed from above. Contrary to the dispersing systems known, wherein mixing and shearing of the components is performed simultaneously in the region of maximum shearing gradient, the method of the invention separates both time and location of mixing and shearing by feeding said components into the premixing chamber (60). The basic principle is that an optimum emulsion be obtained by preparing a homogeneous phase mixture first.

14 Claims, 8 Drawing Sheets

MIXING METHOD AND APPARATUS

Figure 1:
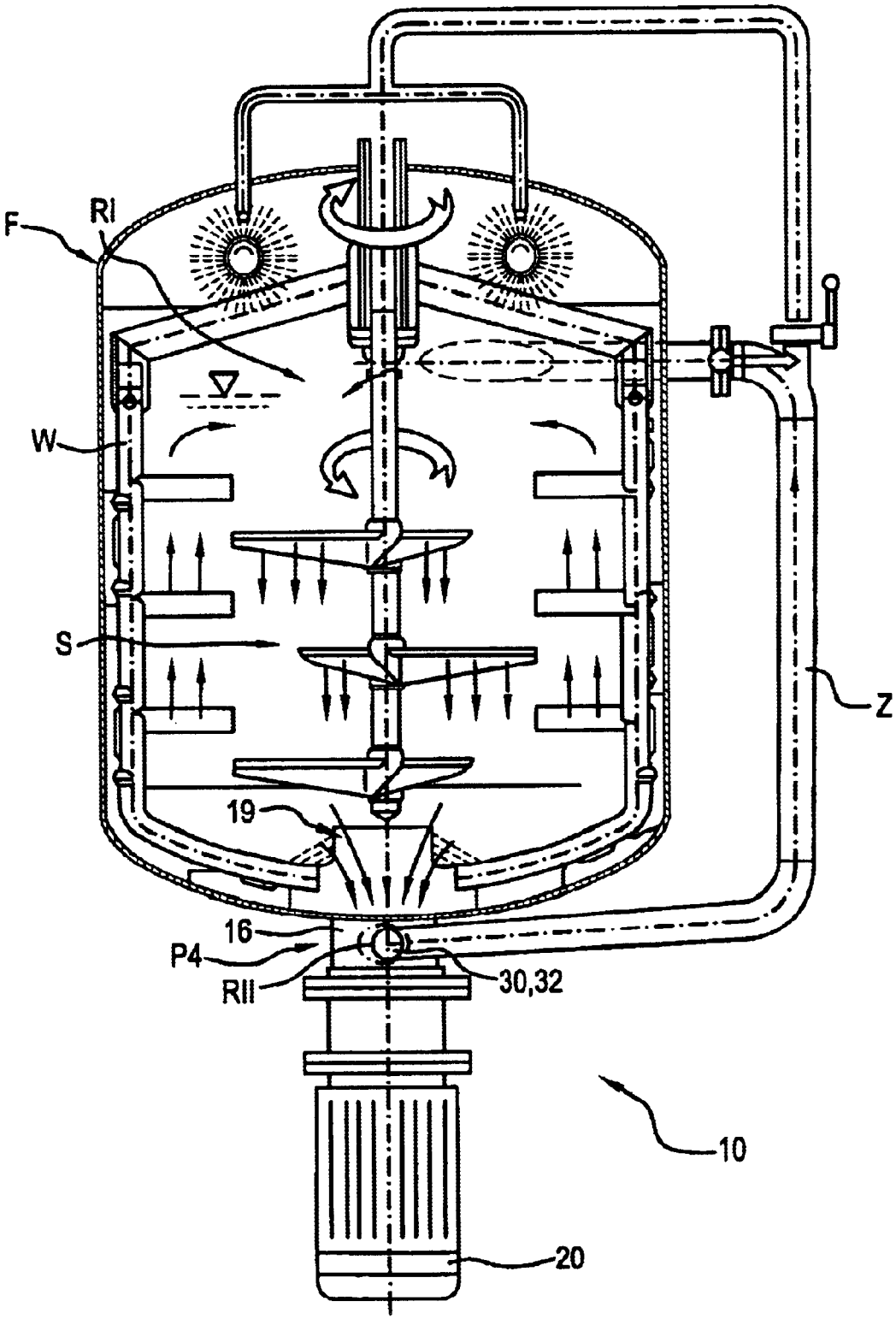

The invention relates to a method and an apparatus for mixing fluids, especially by dispersion and emulgation.

In process engineering, the production of desired final products is generally based on a quantity ratio according to a formula. But for mixing paste-like compounds and emulsions, for example, especially with droplet sizes in the μm range, it may be advantageous to blend two or more reagents in other quantity ratios in order to optimize the generation of the desired product regarding mixing time, total quantity and temperature. Especially if a great quantity of a first reagent is to be combined with a small quantity of a second reagent, thermodynamic and flow processes may make a different procedure advisable or even necessary.

As a reason for deviating quantity formulations, DE 20 04 143 A1 states that the production of suspensions or emulsions with small particle sizes requires a short retention time to avoid a so-called Oswald ripening, i.e. the growth of big particles at the expense of smaller ones owing to solving transformation processes. In crystal growth, supersaturation is achieved by addition of a phase which will influence the number of nuclei depending on the volume unit; after beginning of nucleation, the addition of other solutions mainly contributes to the growth of nuclei or crystals already formed, which will reduce the number of microunits generated altogether. Hence there has been derived in said publication and similarly in U.S. Pat. No. 2,641,453 the technique of bringing two phases together via coaxial conduits. However, this will inevitably result in an adaptation of temperature. Such a heat exchange before mixing may be extremely undesirable for certain processes.

It is an object of the invention to obtain optimum mixing. In an economic way, by stirring especially of such reagents which have to have different temperatures because of their state at least initially or which show different temperature behaviours anyway. For this purpose, a further development of mixing methods known per se in connection with dispersing apparatuses is aimed at, in particular apparatuses which comprise a coaxially toothed rotor/stator system. Another object consists in providing means of production that are permanently reliable in operation and of a design as simple as possible, capable of being produced and installed with a minimum of time and cost They should be usable conveniently and trouble-free without loss of product quality. It is yet another object of the invention, with regard to ecology as well as cost saving, to minimize the energy consumption both in batch operation and generally in the continuous process.

The invention relates to a two-stage dispersing method wherein a partial stream is deviated from the main stream of a reagent I coming from a container and a second partial stream (secondary stream) of a mixture with a reagent II is supplied to said first partial stream, which mixture is produced in a premixing chamber, the mixture of the two partial streams then being fed to the residual main stream via a rotating dispersing apparatus. This method is extremely economic and highly efficient. Partial streams of small quantities may be adjusted easily as required and with very little inertness, most easily by means of a dosing pump. Moreover the partial stream technique has the advantage that the concentration of the reagent to be added only has to have the quantity ratio which relates to the partial stream. This will also apply to the—otherwise often difficult—phase-emulsion emulgation in the hot/cold process.

At an extremely rapid flow rate uniform distribution will be reached even with problematic products by intensifying the mixing under pulsation in a ring or outlet channel, preferably with cyclic pressure buildup and reduction in the prechamber. Especially by dosing the partial streams and by changing the velocity of the dispersing apparatus if need be, the volume and pressure conditions can be controlled economically. Thus reagents with different temperatures and in different concentrations may easily be treated.

For this purpose, dispersing apparatuses known per se with a coaxially engaging rotor/stator system may be used, in which system shearing forces between closely neighboured concentric toothed baskets, of which at least one is rotated, will homogenize the material to be mixed as it passes through, said material being discharged via periodically aligned channels. Depending on the geometry and dimensions of these channels, different velocity components and turbulences will occur at a shear gap. However, a cascade system of two dispersing apparatuses with different working volumes is also suitable where there Is control of the flow rate in the premixing chamber of the second dispersing apparatus.

Cyclic pressure differences in such a dispersing apparatus will support quick and uniform distribution of the reagents in that the reagent I is always fed into the premixing chamber during high-pressure periods, dispersing uniformly with the reagent II in the premixing chamber under turbulence and pulsation in each following period of lower pressure. From the point of view of process engineering, mixing will thus be optimally achieved, irrespective of the quantity ratios to be adjusted for the final product Because of the extremely short retention time of e.g. only 5 ms, minimum heat exchange takes place in the premixing chamber so that a reagent II that Is fed hot will cool down only slightly during intensive mixing with reagent I.

An important feature of the invention is that the main stream and the partial streams receive different energy densities, which will essentially contribute to optimum dispersion and emulgation with the smallest particle or droplet sizes possible. In addition, the mixture of partial streams may be provided in the premixing chamber with an energy density which is considerably higher—e.g. by at least one order of magnitude—than the energy density of the main stream. Where high specific energies are not applied, e.g. when a desired chemical reaction is to be effected, at least good uniformity supporting this process will be achieved. For example, a particle fineness below 0.5 μm may easily be obtained. With non-Newton fluids, a reduction of viscosity generally occurs owing to the Increase of energy during inflow into the premixing chamber, which reduction will substantially improve the mixing with low-viscosity substances. The energy density and retention time in the partial stream, i.e. the volume- and time-related energy input, may be controlled so that a critical energy density resulting in an emulsion reversion will not occur, which is very important e.g. for the production of mayonnaises, dressings, etc.

Where a separate dispersing apparatus is used, this will be continuously charged only with that portion of the main stream of R I to which the reagent R II is dosed in the premixing chamber in a quantity corresponding to the total stream, whereby a superconcentration of R II in the outlet stream of the dispersing apparatus will be achieved. Then the superconcentrated mixture (R I+II) will be treated in a small-size high-pressure homogenizer and be remixed with the remaining reagent R I'. In comparison with prior art, the necessary expenditure is markedly reduced. Nevertheless high-quality final products will be obtained in an extremely efficient way.

In a mixing zone—preferably defined by the premixing chamber—, the mixture (R I+II) may be adjusted as to temperature and quantity ratio without substantial shear load. This zone may be followed by a zone of maximum shear defined by the rotor/stator system, especially at a long tooth edge of the rotor, whereby the adjusted partial stream method surpasses the conventional technique by far. A phase mixture may be produced from the reagents in the premixing chamber under different velocities and different static pressures, with a phase I being fed directly into said chamber and a phase II getting into the premixing chamber via inlet channels by means of pulsation due to of cyclic pressure differences.

For homogenization of substances, e.g. paste-like compounds, and/or for production of emulsions with droplet sizes in the μm range, using a dispersing apparatus arranged in or on a container with at least one rotor/stator system, in particular near the bottom of the container, and with feeding devices for a carrier stream if necessary, the invention, provides for two-stage generation and mixing of defined partial streams by producing in a first process step an initial product from a reagent or wax solution and by adding this product to the carrier stream in a second process step. Within the scope of the present invention, the term wax comprises all substances that are solid at ambient temperature and liquid or flowable at an increased temperature, such as fats, paraffins, esters, etc. It is a great advantage of the new processing that the carrier need not be heated to the wax melting temperature, but may remain at ambient temperature. The resulting product will nonetheless have a very high degree of homogeneity because the droplet size may be controlled for an actual product by adjusting the energy density; therefore it will meet the quality requirements.

In a modification, a hot reagent stream (secondary stream) is united in a first process step by which a partial stream Is branched off from a main cold carrier stream in a dosed quantity and—with addition of the energy necessary for the droplet size—is dispersed, whereupon the mixture is remixed with the remaining part of the carrier main stream in a second process step to obtain the final product. Optimization of the volume ratio between the partial stream of the carrier and the partial stream of the initial product will reduce the number of production cycles considerably; the desired concentration of reagent II in reagent I may be obtained after one cycle already. For example, a processing duration of just 15 min for 2000 kg of cream can be easily reached. Agglomeration as with Oswald ripening will not occur because the emulsion quantity necessary for absorption of the added wax is small, and noticeable cooling down is thus avoided. The wax can be worked into the carrier at high energy density without striation. Particle fineness is substantially assisted by the admission of energy to the rotor/stator system wherein the increase of surface energy is reached or even many times exceeded. During the subsequent shock-like cooling down at the big volume of the main stream of the cold carrier, the wax particles will harden so that secondary agglomeration is avoided. Thus a homogeneous particle-size distribution will be reached and consequently a substantially improved product behaviour.

Very advantageous is a self-dosing design of the process whereby the hot reagent partial stream (secondary stream) supplied below the rotor/stator system is dispersed in a premixing chamber with a first partial stream of the carrier, the resulting initial product being diluted, by recirculation with the main stream which flows in from above, and being remixed to a final stream. The reduced pressure of an upside-down cone in the premixing chamber will assist the dosing of the partial or secondary stream of the reagent At high rotor speed, peripheral velocities above 20 m/s may occur in the rotor/stator system so that the medium present in the premixing chamber will be pressed vigorously outward through the dispersing apparatus owing to high centrifugal acceleration whereby the energy is increased.

Mixing of the partial and the main stream will be promoted by control of the static pressures, especially if a static pressure exceeding that of the main stream is produced in the second partial stream. For this purpose, the premixing chamber may be assigned to the lower and radially outer parts of the rotor, and the initial product may first be diverted outwards before it is accelerated at the upper side of the stator and fed to the mainstream flowing radially more inside. The pressure in the main chamber is expediently set by means of its dimensions and by the choice of the ratio between inlet and outlet cross-sections.

Contrary to known dispersing systems wherein mixing and shearing is performed simultaneously in the area of the maximum shearing gradient, mixing and shearing are separated in the method according to the invention regarding both time and location. By supplying a homogeneous phase mixture into the premixing chamber, an optimum emulsion can be produced whereas with the dispersing units known, a considerable portion of the area of maximum shearing is used up for mixing. When the product has passed the rotor/stator system, it may be fed as outlet stream into another container where the product is held homogeneous, e.g. by means of a slow-running agitator or stirrer. This will save energy and will further counteract any Oswald ripening.

If powdery substances are required for the final product, they will be added to the main stream from above so that they are quickly vortexed and absorbed by the main stream at high speed.

The invention further relates to a device serving for homogenization of substances, e.g. paste-like compounds, and/or for production of emulsions with droplet sizes in the μm range, and being provided with a dispersing apparatus on or in a container having at least one rotor/stator system near the container bottom, with a product inlet at the upper side and at least one feeding device arranged in said upper zone if necessary. A supply line for especially a hot reagent leads into a premixing chamber below the rotor, which chamber has or may have a flow connection, via an outlet channel with a main chamber at the bottom of the rotor/stator assembly, and therefore requires very little space. The device according to the invention is also extremely favourable in respect of power consumption. It represents a considerable further improvement over conventional devices, e.g. according to DE 296 08 712 U1, which have V-shaped or wedge-like stator and/or rotor projections that have a decisive influence on the flow behaviour due to different surface portions and sharp edges. Compared to a dispersing device according to DE 296 08 713 U1, which causes disproportionate changes of the shearing-gap volume by readjustment of the axial distance between stator and rotor, the invention also achieves a substantially accelerated dispersion by incorporation of the premixing chamber.

The premixing chamber is preferably arranged in the outer area of the rotor between its bottom and the confining wall of the casing, particularly in such a way that it reaches from the center of the rotor bottom up to an outlet of the premixing chamber. Requiring a minimum of space, said premixing chamber is thus optimally accommodated at the rotor/stator system. The outer stator ring may include stator teeth that project downwards from the main chamber, overlapping the rotor circumference with a minimum of clearance without contacting it and that extend to a bottom flange located centrally opposite the rotor bottom. This design contributes to producing an increased static pressure in the premixing chamber which is thus limited to a small volume wherein an intensive initial dispersion—e.g. of a hot reagent fed—takes place without disturbing cooling-down effects.

Advantageously a supply line leads into a preferably inclined inlet channel which is integrated into the bottom flange as a radial channel parallel to the bottom, in particular opposite the outer bottom of the rotor. The construction may be designed so that the rotor has its maximum diameter and circumference, respectively, at its flat or concave top, with an outer surface reentering toward the rotor bottom from a peripheral edge or curve.

A very intensive radial feeding of the medium will be achieved if a deflecting body consisting of a flat cone reaching up to the area of the premixing chamber and having at least one cone-shaped or concave outer surface with a steeper cone sector angle, is formed at the bottom of the rotor, the transition between neighbouring deflection surfaces being preferably designed as a sharp edge in order to obtain additional vortexing. Consequently at least two conical and/or curved surfaces bordering obtuse-angled on each other may peripherally enclose a stepped surface of the rotor hub and have angles that become steeper to the outside. Said deflection surfaces will guide the partial stream particularly effectively into the main chamber. Therefore the vigorous centrifugal flow at the outer stator ring has already an axis-parallel component which will most effectively enhance the introduction of the partial stream into the main chamber.

A preferred embodiment has a stator with a hood which confines, outside the outer stator ring, a deflection chamber provided near the bottom flange with outlet orifices distributed over the circumference, the feeding element being arranged adjacent the rotor directly above the inlet formed centrally in the hood. This extremely compact assembly may be flanged directly to a container bottom. It ensures a high degree of homogenization by recirculation in a narrow space.

Dispersing apparatuses are typically manufactured with very small tolerances for precise assembly. Especially in view of the small minimum clearances in the axially adjustable rotor/stator system, which may be down to 0.1 mm, a drive designed as hollow shaft motor is very useful, with support by a bottom flange and a bearing flange arranged at right angle. In order that the driving shaft inserted fractionally in the hollow shaft be dimensionally stable during operation, the rotor shaft is preferably axially supported within a slide ring packing by stops and disc springs so that a linear extension of the hollow shaft and thus of the driving shaft will only be possible in the direction away from the bottom flange. Thus heat influences caused by the underlying motor will be reliably compensated for in a surprisingly simple way. Though the driving shaft may reach temperatures of e.g. up to 120° C. in continuous operation, practically no thermal expansion will thus occur at the dispersing apparatus arranged above; rather, linear extensions of the hollow shaft of the motor, which are inevitable during heating up, will occur only in the direction leading away from the dispersing apparatus. Therefore an optimum shearing effect will always exist at the rotor/stator system owing to the invariably narrow gap. For adjustment of a pulsation effect, the pressure distribution in the dispersing apparatus is controlled at the outlet side, preferably by choosing the flow path, the flow distance and the looping angle, respectively, in the outlet channel behind the outlet socket; or by means of surface dimensioning and arrangement of the outlet orifices, which permits easy adaptation to special operating conditions.

An attachment to be flanged to the container bottom may have an inlet pipe surrounding the feeding element, which provides for particularly vigorous suction of the medium. From an outlet socket, a line branches off which may be controlled by e.g. a valve and which returns to or into the upper part of the container, if desired with such a tangential angle that a product rotation generated by the agitator or feeding element will be slowed down. Air pockets will be avoided if the line is returned below the minimum product level in the container. The return line can be heated or cooled as required and be installed at least partly outside the container which holds e.g. 16 I [liters] in a laboratory plant and e.g. 10,000 l [liters] in an industrial plant with high dispersion powers, e.g. In the range between 30 and 50 kW, this new possibility of external cooling is a great advantage.

Further reduction of droplet sizes will be achieved by admitting ultrasonic action to one or both stages of the dispersing apparatus, for which stages the rotor forms an intermittent reflector. The rotor teeth rotating past the stator teeth will thus provide an intermittent-continuous homogenization of the product.

Important is the possibility to adjust the passage volume in the area of the premixing chamber, especially by changing the shape of the rotor and/or of the stator w unchanged shear edge length. If the stator orifices in the second stage are modified (with the device remaining otherwise unchanged), the shear gradient and thus the volume-related energy will be influenced whereas the shear edge of the stator teeth confining the premixing chamber remains the same. Conversely, in order to influence the energy density of the partial stream and the retention time, the shear edge length may be adjusted while the premixing chamber volume remains the same. The process behaviour may thus be optimally adapted to the actual mixing job with relatively simple devices.

As an alternative for the aforementioned integrated constructions, the invention provides for a separately attachable predispersion stage, especially for retrofitting existing homogenization or dispersion plants in an economic way. Such a separate dispersing apparatus is continuously charged only with that portion R I" of the main stream to which the reagent R II has been dosed in the premixing chamber in the quantity corresponding to the total stream R I. A superconcentration of R If will develop in the outlet stream mixture of the dispersing apparatus, then to be treated in a considerably smaller high-pressure homogenizer and be remixed with the remaining reagent stream R I'.

Figure 2:
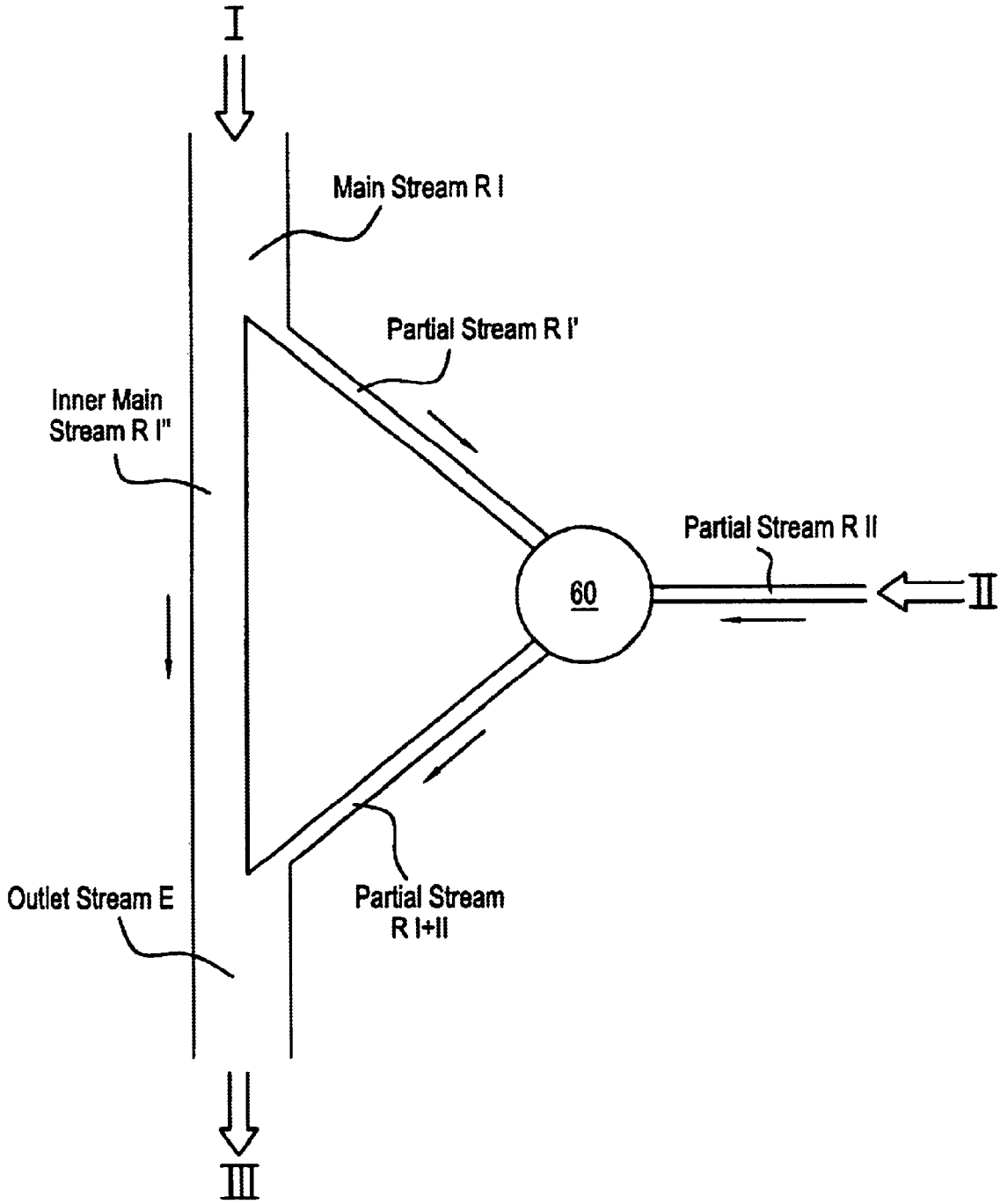
Figure 3:
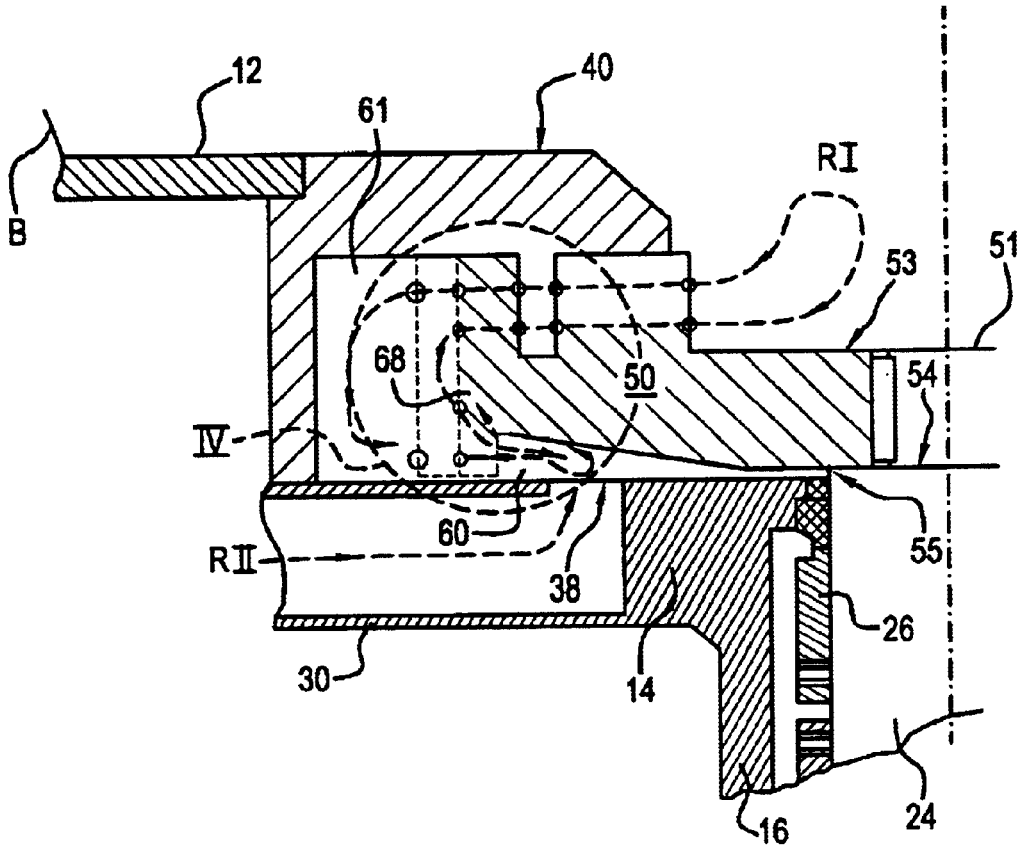
Figure 4:
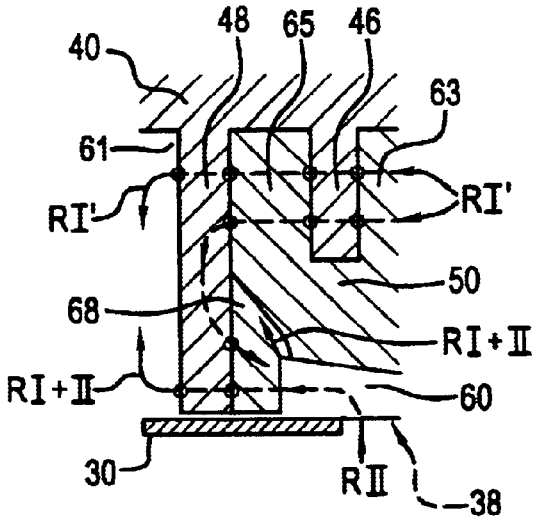
Figure 5:
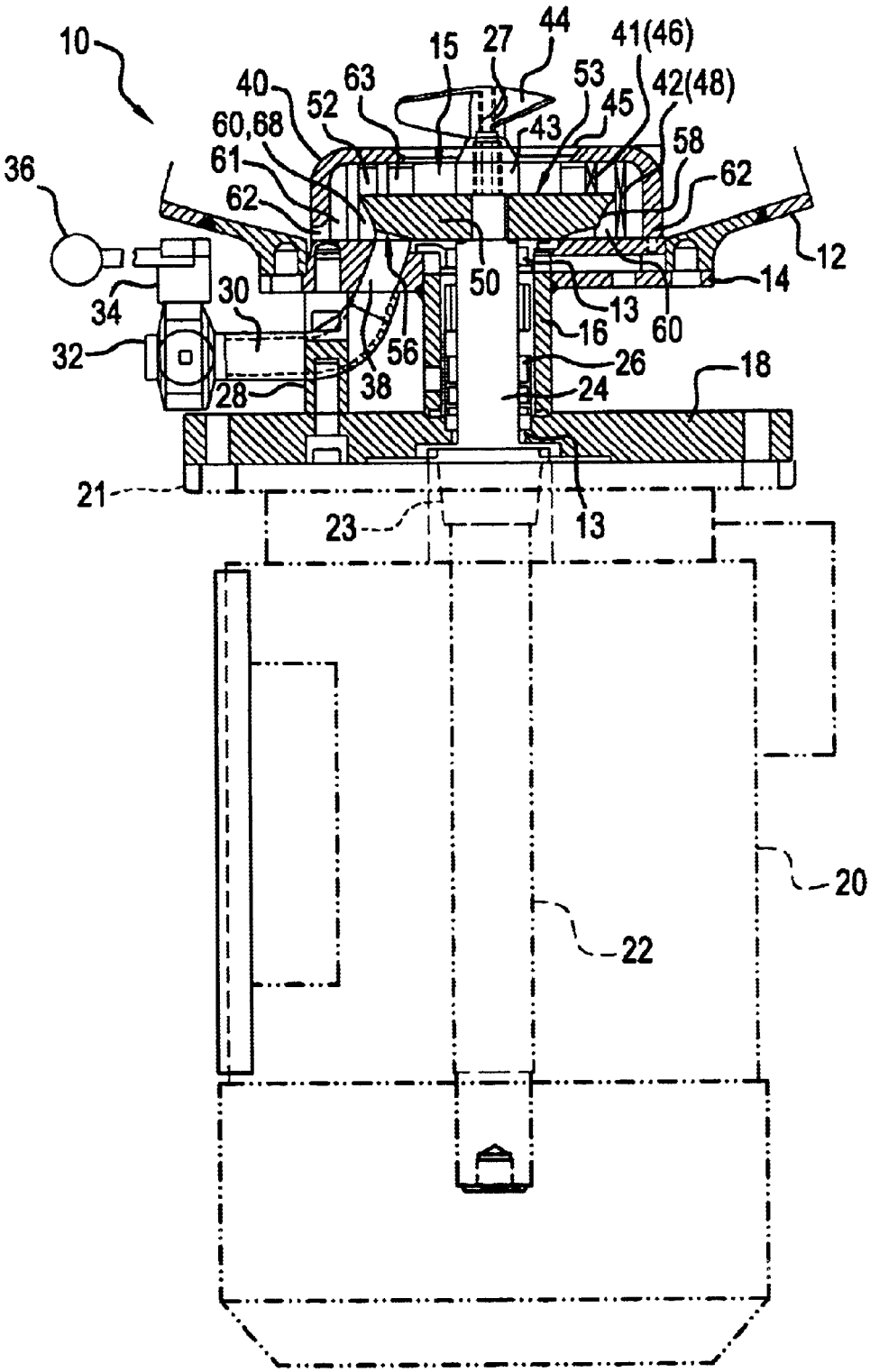
Figure 6:
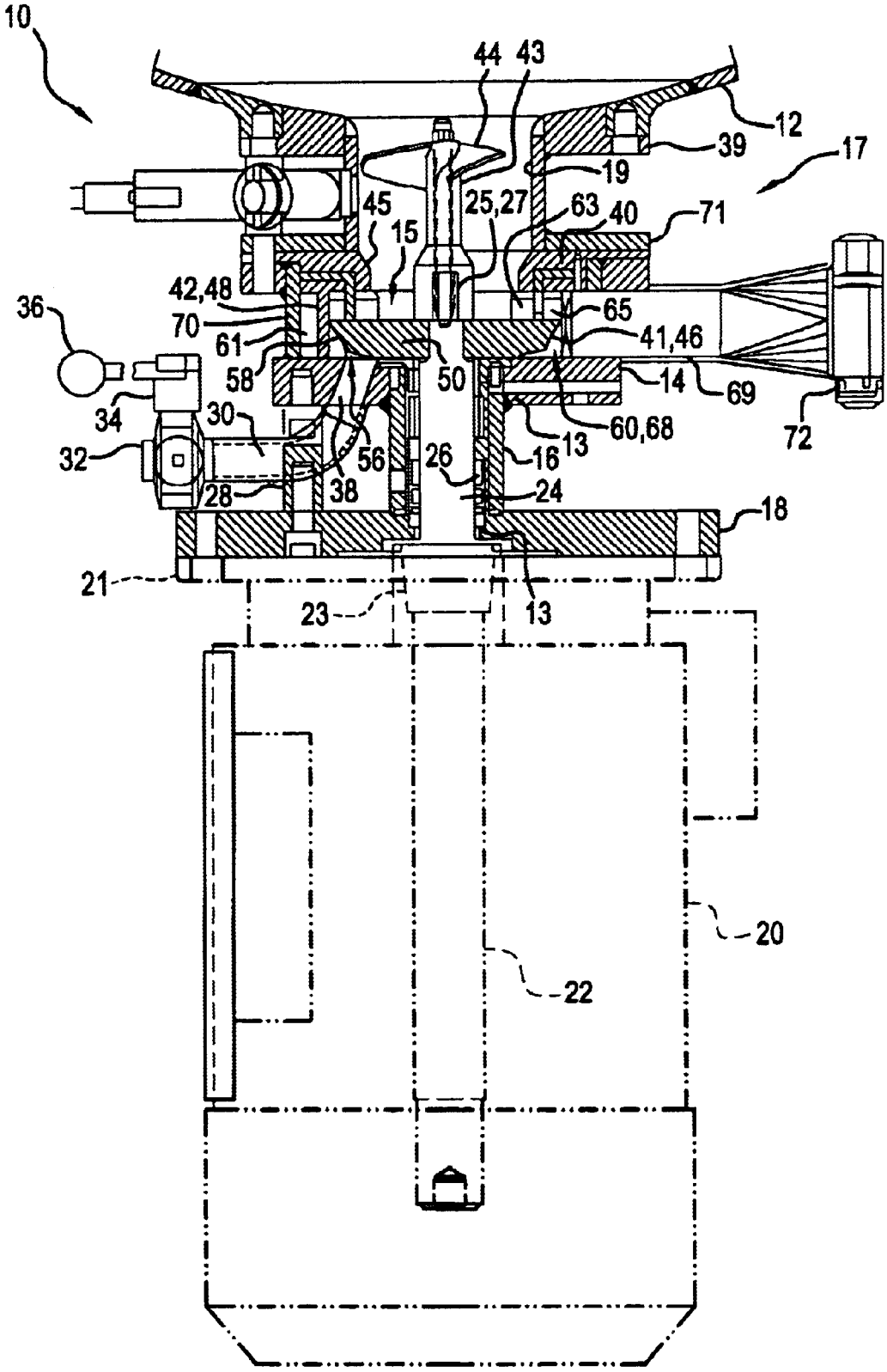
Figure 7A:
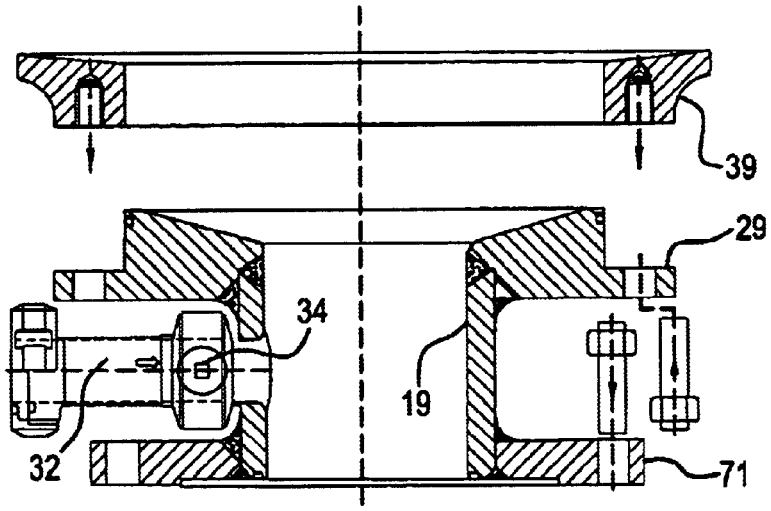
Figure 7B:
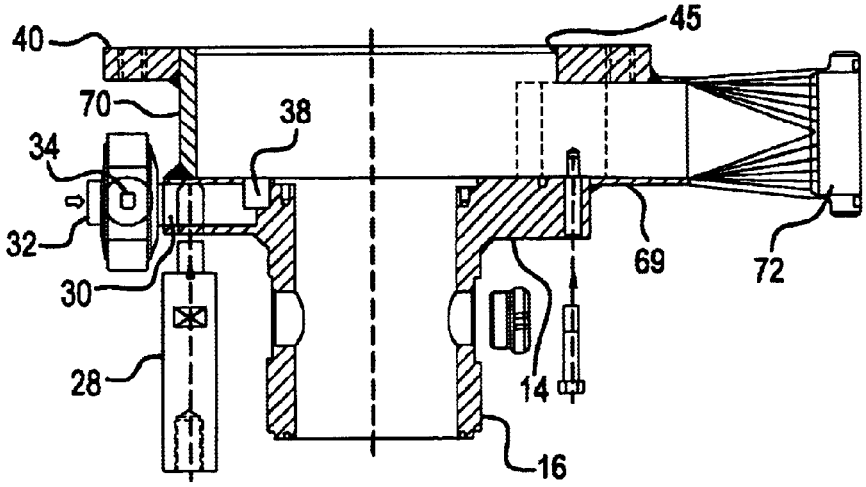
Figure 7C:
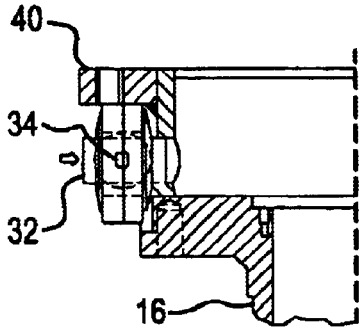
Figure 11A:
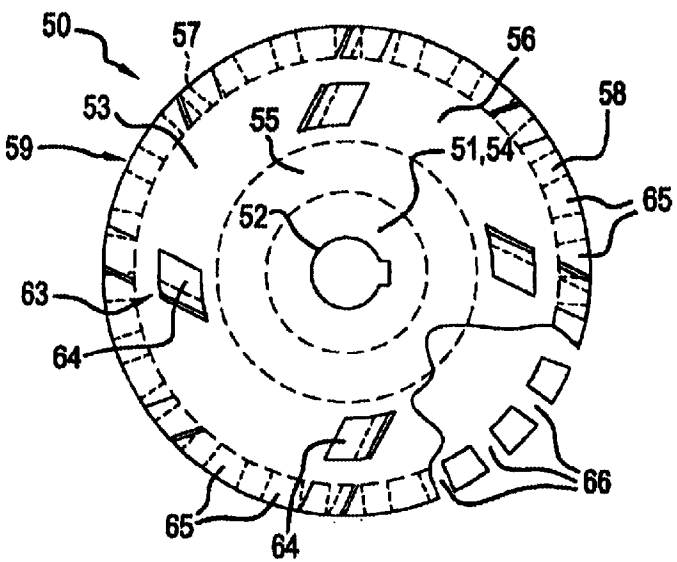
Figure 10B:
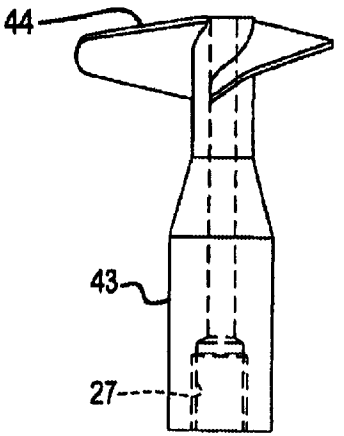
Figure 10A:
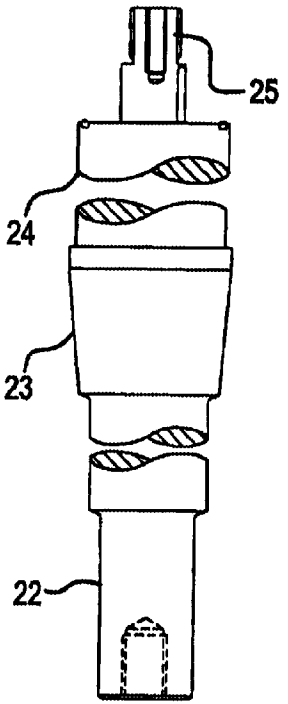
Figure 11B:
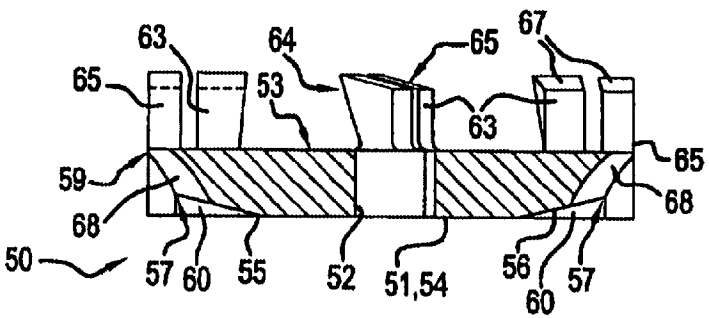
Figure 11C:
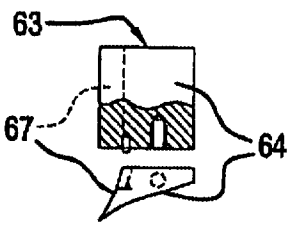

Further features, details and advantages of the invention will follow from the wording of the claims as well as from the following description of embodiments shown in the drawings wherein:

FIG. 1 is a schematized axial cross-sectional view of a process container with flanged-on dispersing apparatus, FIG. 2 is a flow diagram, FIG. 3 is a partial cross-sectional view of a rotor/stator system with a premixing chamber, FIG. 4 shows an enlarged detail corresponding to zone IV in FIG. 3, FIG. 5 is an axial cross-sectional view of a homogenizer with a schematically indicated drive, FIG. 6 is an axial cross-sectional view of a similar homogenizer with an attachment, FIGS. 7*a*, 7*b*, 7*c* show axial cross-sectional views of different parts of an attachment according to FIG. 6, partly in exploded view (FIG. 7*a*), FIGS. 8*a*, 8*b*, 9*a*, 9*b* show each a plan view, party sectional, of stator rings, FIGS. 10*a*, 10*b* are side views of a driving shaft as well as of a stirring shaft to be coupled to it and FIGS. 11*a*, 11*b*, 11*c* show each a plan view and a side view, respectively, of a rotor and of projections.

FIG. 1 shows a schematized survey of a mixing plant comprising a container F with an incorporated agitator S and a counter-rotating straight arm paddle agitator W which has an inlet pipe 19 at its lower end. Said pipe 19 faces a bottom flange 14 (FIG. 5) by means of which a socket 16 of a dispersing apparatus 10 is attached to the casing 12 of a container F for which FIGS. 5 and 6 show different examples. A feed line 30 having a connection 32 leads with an inlet 38 (FIG. 3) to the bottom flange 14. The dispersing apparatus 10 is connected via a return or recirculation line Z to the upper part of the container F. Into a lid of the latter, a pressure system projects that is provided with a shut-off device and with spray heads for periodical cleaning. Alternatively the dispersing apparatus may also be used without recirculation line in accordance with the embodiment of FIG. 5.

The typical course of a process is evident from FIG. 2. In a container F (not shown) a carrier (reagent I) is kept ready according to the formulation. A receiver (not shown either) supplies an additive (reagent II), e.g. hot wax. Via a dosing device, the receiver is connected to the feed line 30 of a premixing chamber 60 of the disperser 10. The agitator S—if available—is started in the container F, whereupon the dispersing apparatus 10 is put into operation. Now the reagent I flows through the disperser 10 and via the recirculation line Z (or directly) back into the container F. The dosing device at the receiver is switched on so that the reagent II will flow as partial stream R II into the premixing chamber 60 of the dispersing apparatus 10 where it will max with the partial stream R I' of the reagent I in an extremely short time.

The components (R I+R II) are intimately dispersed in the premixing chamber 60, resulting in fine to finest dispersion depending on the process conditions chosen. Because of the static pressure differences and of the geometry of the premixing chamber 80, the partial stream R I+II formed will combine and mix with the remaining main stream R I" of the reagent I of the dispersing apparatus 10. This product III, often already the final product consisting of the reagent I enriched with the reagent II, is returned as a final stream E into container F. Its circulation through the dispersing apparatus 10 will be continued until product III has reached the formula concentration of reagent II in reagent I. In most cases, the addition of an emulsifier is not necessary at all or only in a small doses.

Tests have shown that small quantities of other formulas may be treated likewise. FIGS. 3 and 4 show details of the mixing zone and of the premixing chamber 60, elucidated by the examples of FIGS. 5 and 6 in combination with the following explanation of the basic layout.

A rotor shaft 24 passes through an inlet pipe 19. At its lower end, said shaft is provided with a recess 27 by which it is connected via a coupling extension 25 to a shaft 22 (FIGS. 10*a*, 10*b*) of a driving motor 20 attached to a supporting flange 18. In FIGS. 5 and 6, the contours of motor 20—which is rather heavy when high-powered—are only indicated by dashed lines, as is a lateral terminal box (on the right) for electric connections (not shown). At its upper end, the motor shaft 22 has a cone bearing 23 as second bearing for stabilization of rotor shaft 24 which latter is supported via disc springs 13 by the bottom flange 14 through a fixed bearing and by the supporting flange 18 through a loose bearing. The supporting flange 18 holds the socket 16 and is additionally supported by the bottom flange 14 through distance pins 28. The motor 20 is sealed against the container by means of a slide ring packing 26.

The rotor shaft 24 holds a hub 51 of a rotor 50, and its free end is connected above in a non-rotatable way to an agitator shaft 43 which holds an agitating element 44 shaped as a propeller. The lower side of the rotor 50 faces the bottom flange 14 directly in which an inlet channel 38 is arranged, especially in an inclined manner, into which channel a feed line 30 leads that is preferably integrated into flange 14 parallel to its bottom, e.g. in a radial direction. Alternatively said feed line may be an external pipe which inclines toward the mouth of the inlet channel 38. The connection 32 with a shutoff element 34, e.g. a rotary slide valve or another valve, serves for supply of hot wax from a storage reservoir (not shown). An operating lever 38 may optionally be arranged in a way other than shown.

Figure 8B:
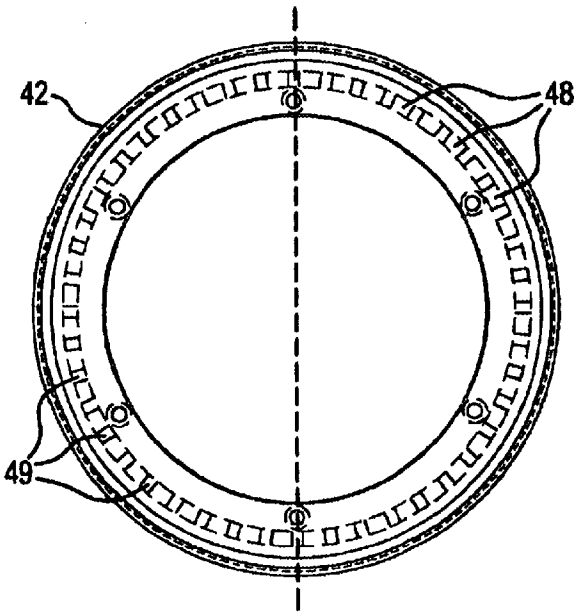
Figure 9B:
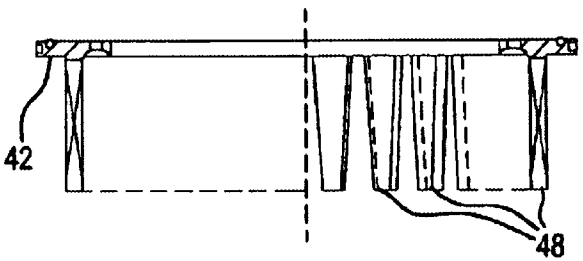
Figure 8A:
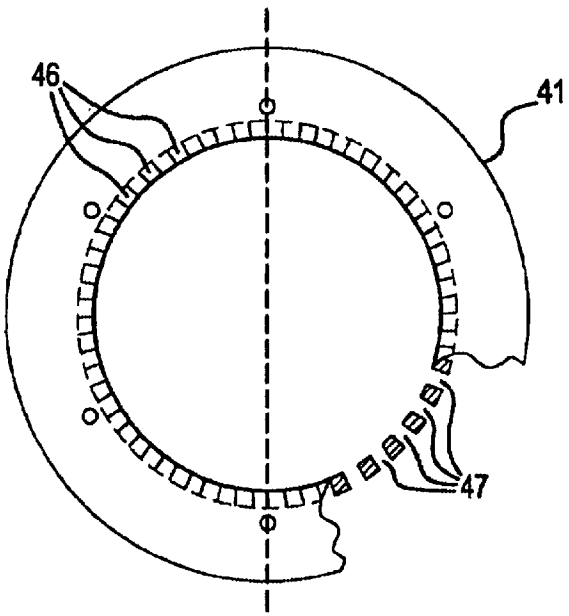
Figure 9A:
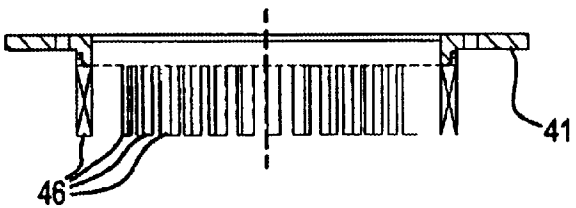

The bottom flange 14 is rigidly or Integrally connected to a stator 40 that reaches over the rotor 50 from above and has a suction orifice 45 below which there is a main chamber 15 confined at the bottom by the top face 53 of rotor 50. Both stator 40 and rotor 50 include gears or cogwheels which have axis-parallel teeth and which are fitted into each other with minimum radial clearance. Thus the stator 40 has an inner stator ring 41 with inner stator teeth 46 and an outer stator ring 42 with outer stator teeth 48. Radially further inside, the rotor 50 has inner projections or teeth 63 as well as outer projections or teeth 65 between which there are radial outlets 66 (FIG. 11*a*). Corresponding radial outlets 47 are provided on the inner stator ring 41 (FIG. 8*a*), as are radial outlets 49 on the outer stator ring 42 (FIG. 8*b*). The projections 63, 65 of the rotor 50 protrude vertically from its upper side 53 (FIG. 11*b*) and have inclined lateral and top surfaces, the upper ends of the teeth 63 and 65, respectively, comprising inclined surfaces 67. All teeth or projections 63, 65 may have vane-type faces 64 which are inclined in a circumferential direction (FIGS. 11*a*, 11*c*).

Important is the design of the rotor 50 (FIG. 11*b*). Its hub 51 has a central bore 52 and a plane face 54 bordered by a stepped surface 55 parallel to the top surface 53. At a radius defined by the position of the mouth of inlet channel 38, there is a transition from the stepped surface 55 to a flat cone 56. Following a sharp edge 57, a concave outer surface 58 extends under a steeper angle to the periphery 59 near or at the top surface 53. In this area, the outer stator teeth 48 with minimum clearance over the rotor 50 which has its greatest diameter here and is provided at its circumference with a number of preferably concave outlet channels 68 (FIGS. 3 and 4).

The premixing chamber 60 is of central importance for admixing and dispersing. It is arranged between the inner perimeter of the outer stator teeth 48, the outer surface 58 of the rotor 50 and the adjacent upper side of the bottom flange 14. In this small volume which includes in a periphery position the volume of the corresponding outlet channel 68, the hot reagent II coming from the feed line 30 after deflection at the flat cone 56, which acts as reflecting surface, is vortexed into a mixture with the medium I already available in the main chamber 15. Said mixture flows as partial stream R I+II through the assigned outlet channel 68 to the outer stator teeth 48 and through the outer radial passages 49 into a deflection chamber 61 and continues as dispersed fluid along the casing 12 through radial outlets 62 of the stator 40 into a container (not shown). The agitating element 44 will steadily feed the main stream R I from the container F to the inner main chamber 15 until the dispersion has reached the desired degree of homogenization. The final stream F of the final product III is drained via an outlet (not shown).

The embodiment of FIG. 6 is of the same principal design; therefore, corresponding components bear reference numbers already mentioned. In this configuration, the stator 40 is not a hood but features a top plate provided with a central suction orifice 45 and rigidly connected to a cylindrical casing 70 which is closed at the bottom by the also rigidly attached bottom flange 14. The preferably inclined inlet 38 is connected to the connection 32 in a space-saving way by a feed line 30 again which is designed as a radial channel in the flange 14 running parallel to the bottom. At a position of its periphery; the casing 70 has a socket 69 (FIGS. 6, 7*b*) with a connection 72 for a return line (not shown here) to the upper side of container F.

The stator plate 40 is crowned by an attachment 17 fixed by means of a fastening flange 71 for enclosing the agitating element 44 in an inlet pipe 19 (FIG. 7*a*) that is welded to the flange 71 and is rigidly connected to an upper flange 29 onto which a flange ring 39—shown in exploded view in FIG. 7*a*—is attachable, which ring may be screwed to the casing 12 and a connected flange socket, respectively.

In another design of the attachment 17 (FIG. 7*b*), the casing 70 has a reduced wax feed connection 32 which as part of the bottom flange 14 is welded thereto directly below casing 70. In the example of FIG. 7*c* which is different again, the connection 32 is inserted directly into the wall of the casing 70 whereby additional saving of space is achieved.

A special problem results from the fact that for the development of new formulations relatively small laboratory plants of e.g. 3 . . . 16 l [liters] content with accordingly small powered dispersing apparatuses (e.g. 1.5 . . . 5.5 kW) are naturally used at first The conversion into industrial scale conventionally involves great and time-consuming efforts varying thermal conditions and different ratios between surfaces and volume make the change to great volumes of e.g. 500 . . . 5000 l [liters] rather complicated, the more so if a transformation factor of 300 is exceeded. Many formulations are substantially influenced by mixing the hot wax additive with the comparatively cold carrier. According to the invention, this process takes place in the predispersing chamber whose volume mainly depends on the rotor diameter which, in turn, determines the power consumption of the rotor to the power of five. It has proved to be a great advantage of the new adjusted partial stream process that for the change from a 3.0 kW laboratory plant to a 45 kW dispersing apparatus, the rotor has only to be enlarged in a ratio of 1:1.72 which corresponds to a ratio of 1:2.95 of the volume increase in the predispersing chamber. This can be considered to be infinitesimal as against the transformation factor of 300. During practical tests, the formulations developed in the laboratory plant could be identically adopted for the production plant, with the produced product matching the laboratory result perfectly. Because of the small active volume and no more need for carrier heating up time, the production time required for this process step is considerably decreased. For example, with 200 kg for a batch cycle, the average time sank from 2.5 h to 40 min from the beginning of container filling to the end of pumping off. The result is a considerable saving of energy, apart from the great increase of the daily production.

Application Example A: Mixing of Fatty Acid and Lime Milk

In the production of mixtures of fatty acid and lime milk, e.g. for the production of cleaners, fatty acid is dosed into the prechamber 60 as the reagent II. The dissolved CaOH complex of the partial stream R I' of the reagent I (lime milk) is sufficient to neutralize the weak fatty acid. During remixing the saturation concentration is reached again by the CaOH in suspension. The previously annoying formation of agglomeration of lime and fatty acid is successfully avoided by the partial stream method.

Application Example B: Addition of Flocculants in Water Treatment

In water and waste-water treatment, a ppm range of flocculants and coagulation inhibitors (e.g. aluminium sulphate) is added. As it is difficult to homogeneously dose these substances in operating plants, overdosage has often been necessary, involving a considerable increase in costs. It is now possible according to the novel method to lead a partial stream of 10% to 1% of the water quantity via a dispersing apparatus 10 with a prechamber 60 and add to this (via connection P4 of the disperser 10) the flocculant or anticoagulant. The recirculation line Z leads directly back into the treatment basin of the total water quantity. Consequently the addition takes place there.

In a much more favourable mixing ratio of 1:10 up to 1:100. The extremely short retention time of the flocculants in the shearing area of the dispersing apparatus prevents the destruction of the molecule chains of the flocculants. A greater clearance between rotor and stator is of advantage.

Application Example C1: Exothermic Processes

In many chemical reactions heat is released which has to be dissipated for a controlled reaction sequence. With the adjusted partial stream method according to the invention, the quantity ratio between reagent I and reagent II can be exactly adjusted so that the cooling of the recirculation line Z corresponds to the reaction heat amount

Application Example C2: Endothermic Processes

The introduction of heat by the rotor/stator system 40/50 will often suffice in endothermic processes to obtain the necessary amount of heat for the solution. In this case a high energy density is advantageous even though the particle/droplet size is of secondary importance as far as the method is concerned.

Requirements of the Dispersing Apparatus

The essence of the method and of the apparatus according to the invention is a two-stage dispersion with the following main requirements to the dispersing apparatus 10:

a) a premixing chamber (60) of a small volume into which a partial stream R I' flows from a container (F) containing e.g. reagent I;

b) a device for feeding (32, 38) e.g. reagent II into this prechamber (60);

c) adjustment of a desired pressure distribution by the design and dimensions of the outlet (69) and of the cross-sectional ratio of the outlet orifices, respectively;

d) adjustability of the volume of the mixture stream R I+II, e.g. by selecting suitably shaped mixing tools or by targeting the passage volumes of the stator teeth (46, 48);

e) definition of the partial stream/main stream pressure conditions which are substantial for the product homogeneity, e.g. by trapezoidal outer stator teeth (48).

Owing to a suitable shape of the premixing chamber 60 and a high speed rotor 50, a mixing and dispersing time in the ms [millisecond] range is possible. Cooling-down of reagent II below the solidification threshold will be thus avoided especially in example A, even with high portions of wax. A favourable temperature level for homogenization and dispersion, respectively, will be reached by adjusting the mixing ratio. The speed of the disperser motor may be adjustable e.g. by specifying the frequency and/or constant output current Thus the energy supplied can be kept constant even where viscosity varies during the process.

If emulsions or viscous products are prepared, it is advisable to return the outlet of the recirculation below the liquid level in the container to avoid penetration of air. For processes according to example B, the unit is provided with an external recirculation line (Z) which may be heated and/or cooled as required.

Where a single plant (i.e. without cascade system) is used, a branch-off means for the partial stream of the plant is necessary. If e.g. two dispersing apparatuses are used, with a second smaller dispersing apparatus having a premixing chamber 60 for enacting the two-stage principle, a high-pressure homogenizer may be additionally inserted into the recirculation line Z from the second dispersing apparatus to the container F for ultrafine dispersion. In the hot-cold process according to example A, the final product, i.e. the reagent II, is heated to an optimum temperature for the high-pressure homogenizer by absorption of energy in the two dispersing stages and by admission of the hot reagent II. Said homogenizer has only to be dimensioned for the partial stream R I+II, which will advantageously save a lot of costs and energy. This variant is particularly suitable for feeding "difficult products", such as vitamin E.

A high-pressure homogenizer may also be interconnected in a single two-stage dispersing apparatus 10 provided a suitable partial stream connection is available.

FORMULATION EXAMPLES a) Elegant Night Cream (Formulation by Henkel KGAA)

For 2000 kg of a final product, about 600 kg of hot-phase ingredients are required. Said ingredients—among them beeswax—are melted in a container and heated to 80 . . . 85° C. The ingredients of the cold phase are fed to the container F into which water of approx 15° C. is filled from above. At a reduced pressure of e.g. 0.5 bar, the other cold phase constituents are added while the homogenizer is operated at an average speed for 5 min. After the addition of water, the agitator S attached to the wall in container F is also switched on. Said agitator is suitably provided with a coaxial, double-motion stirring system so that homogeneous remixing will be achieved. The hot phase is then added via connection 30, 32 which leads directly into the premixing chamber 60. While the dispersing apparatus 10 rotates with a speed of approximately 3000 $min^{-1}$ for about 15 min, the motor current has to be kept constant at e.g. 40 A. Though variable viscosities may cause speed changes, constant energy supply is achieved. The dispersing apparatus 10 is alternately switched off and on during final reagitating periods of 5 min each.

Energy Balance

| | |
|---|---|
| 25 min of operation of the 30 kW disperser inclusive of discharge, current consumption | 12.50 kWh |
| 40 min of slow operation of the 5.5 kW agitator will consume | 3.67 kWh |
| Heating of the hot phase will require | 35.00 kWh |
| Total consumption of energy | 51.17 kWh |

With the conventional hot/hot process which takes at least 2.5 h, the energy balance is as follows:

| | |
|---|---|
| Heating of both product phases to 80 . . . 85° C. | 116 kWh |
| Dispersing during 0.5 h | 15.5 kWh |
| 2.5 h of slow agitator operation | 13 kWh |
| Cooling down to 35° C. | min. 116 kWh |
| Total consumption | 260.5 kWh |

It will be seen that with this example, the process results in an energy saving of about 210 kWh and, in addition, more than triples the production capacity because of the short production time.

b) Hair Dye

For the production of hair dyes a base preparation is used which is the same for all colours of the same type and which determines the total quantity of water required. The actual hair dye is prepared by addition of the desired shade-determining substances to a reduced quantity of the hair dye base. In a 3000 liter plant equipped with a dispersing apparatus 10 and a double-motion agitating system W, only so much water is added according to the hot/cold method for obtaining the base preparation as is required in the conventional process for the hair dye with the proportionally smallest quantity of water (on general this is the colour black). Part of the hair dye base is then pumped into a smaller plant of e.g. 250 l [liters] which is equipped with a dispersing apparatus 10 including a premixing chamber 60. The substances determining the shade are added via connection P4 to the partial stream R II. The water quantity is chosen such that in the final product III, the water ratio will meet the formulation of the chosen shade, allowing for the possibly smaller quantity of water previously added to the basic product.

The invention restricted to the embodiments described above and may be modified in many ways. The hot/cold partial stream method may advantageously be applied in cases where reagent II, though not solid at ambient temperature, has a deliberately low viscosity when hot so that mixing with reagent I will be performed at a high energy level, e.g. with highly concentrated tensides or vitamin E products. Owing to the high concentration in the partial stream R II fed, the cold/cold batches commonly used in industry may also be processed in a very economic way. In case of substances of low to medium viscosity, it is also possible to convert a laboratory plant having a two-stage dispersing apparatus 10 designed for batch operation into a continuously working production plant. For this purpose, only relatively cheap storage containers for the initially 'hot' and 'cold' substances will be required, perhaps also a dosing device.

It will be seen that a preferred process conduct for homogenization of substances, e.g. paste-like compounds, and/or for production of emulsions with droplet sizes in the $\mu$m range uses a dispersing apparatus 10 arranged at a container F with a rotor/stator system 40, 50 near the bottom and with feeding devices S; 44 if necessary. According to the invention, an e.g. hot initial product generated from a reagent or wax solution is dispersed in a first step in the form of a secondary stream R II with a dosed partial stream of an e.g. cold carrier R I' and is remixed in a second step with a carrier main stream R I" being fed from above. Shock-like cooling-down of the wax particles taking place in the 10 ms range will prevent agglomeration of said particles. The result is a stable mixture or emulsion, respectively, with small droplet sizes adjustable as required for an actual product by control of the energy supply to the rotor/stator system 40, 50. A premixing chamber 60 is assigned to the lower side of the rotor wherein the secondary stream R II is vortexed with the partial stream R I' fed from above or outside. The fastrunning rotor 50 generates an upside-down cone whose reduced pressure will assist self-dosing of the secondary stream R II. By first deflecting the wax-containing mixture R I+II from the prechamber 60 outwardly before accelerating it at the upper side of the stator and feeding it to the inner main stream R I", the static pressure of said main stream will be exceeded. Powdery substances may be added from above. A partial stream feeding device 30, 38 enters the prechamber 60 below the rotor 50, preferably near its periphery: The prechamber 60 is confined in an outer stator ring 42 and leads into a main chamber 59 at the lower side of the rotor/stator system 40, 50 via an outlet channel 68. Outer stator teeth 48 project down to a bottom flange 14 faced by the lower side of the rotor 50 which may be provided with a flat cone 56, a sharp edge 57 and a steeper outer surface 58. An agitating element 44 may be arranged directly above an inlet 45 formed centrally in the hood near rotor 50 or in an inlet pipe 19 above the rotor/stator system 40, 50 where an outlet socket 69 branches off. A recirculation line Z which can be shut off may be installed at least in part outside the container F and/or may be heated or cooled.

All and any of the features and advantages of the invention, inclusive of design details and of spatial arrangements, as evident from the claims, from the specification and from the drawings may be inventionally substantial both per se and in most variegated combinations.

List of Reference Symbols

| | | | |
|---|---|---|---|
| A | plant | R II | partial stream |
| E | outlet stream | R I + II | partial stream |
| F | container | S | agitator |
| R I | main stream | W | straight arm paddle agitator |
| R I" | inner main stream | Z | return line |
| R I' | partial stream | 44 | agitating element/propeller |
| 10 | dispersing apparatus | 45 | suction orifice |
| 12 | casing | 46 | inner stator teeth |
| 13 | partial stream | 47 | radial passages |
| 14 | bottom flange | 48 | outer stator teeth |
| 15 | main chamber | 49 | radial passages |
| 16 | socket | 50 | rotor |
| 17 | attachment | 51 | hub |
| 18 | supporting flange | 52 | central bore |
| 19 | inlet pipe | 53 | upper side/top surface |
| 20 | driving motor | 54 | hub face |
| 21 | motor flange | 55 | stepped surface |
| 22 | motor shaft | 56 | flat cone |
| 23 | cone bearing | 57 | transition/sharp edge |
| 24 | rotor shaft | 58 | outer surface |
| 25 | coupling extension | 59 | peripheral edge |
| 26 | slide ring packing | 60 | pre(mixing)chamber |
| 27 | recess | 61 | deflection chamber |
| 28 | distance pins | 62 | outlet orifices (FIG. 5) |
| 29 | upper flange | 63 | inner projections/teeth |
| 30 | feed (line) | 64 | vane-typeface |
| 32 | connection | 65 | outer projections/teeth |
| 34 | shut-off element | 66 | radial passages |
| 36 | (operating) lever | 67 | inclined surfaces |
| 38 | inlet (channel) | 68 | outlet channel |
| 39 | flange ring | 69 | socket |
| 40 | stator (hood/plate) | 70 | cylindrical casing |
| 41 | inner stator ring | 71 | fastening flange |
| 42 | outer stator ring | 72 | (connection for) |
| 43 | agitator shaft | | return line |

What is claimed is:

1. Apparatus for homogenizing at least first and second substances, comprising a dispersing apparatus arranged in or on a container and having at least one rotor/stator system near a bottom of the container, the at least one rotor/stator system including:

a rotor and a stator, the stator surrounding at least a portion of the rotor;

a first substance feed inlet positioned above the rotor:

a feed line adapted for introducing the second substance to the at least one rotor/stator system for homogenizing;

a premixing chamber in communication with the feed line and positioned below the rotor for combining at least a portion of the first substance with the second substances into a first mix, the premixing chamber (60) having an outlet channel at a bottom of the rotor/stator system for introducing the first mix with a remainder of the first substance to form a second mix.

2. Apparatus according to claim 1, wherein the stator has an outer stator ring, and the premixing chamber is arranged in the outer area of the rotor between a rotor bottom and the outer stator ring.

3. Apparatus according to claim 2, further comprising a bottom flange located centrally and opposite the rotor bottom, and wherein the outer stator ring includes stator teeth that project downwards from a main chamber located above the rotor, the stator teeth overlapping a circumference of the rotor with a minimum of clearance but without contacting the rotor, and extending to the bottom flange.

4. Apparatus according to claim 1, further comprising a bottom flange located centrally and opposite the rotor bottom, and wherein the feed line leads into an inlet channel which is integrated into the bottom flange as a radial channel parallel to and opposite a bottom of the rotor.

5. Apparatus according to claim 1, wherein a deflecting body is formed at a rotor bottom by a flat cone reaching up to the area of the premixing chamber (60) and having at least one concave outer surface with a steeper cone sector angle, the transition between the flat cone and the at least one concave surface forming a sharp edge.

6. Apparatus according to claim 1, further comprising a bottom flange located centrally and opposite the rotor bottom, and wherein the stator (40) has a hood and an outer stator ring, the hood and outer stator ring forming a deflection chamber (61) provided near the bottom flange (14) and in communication with outlet orifices (62) distributed over and formed in a circumference of the stator, and wherein a feeding device is formed centrally in the hood and above the first substance feed inlet.

7. Apparatus according to claim 1, further comprising a bottom flange located centrally and opposite the rotor bottom and a drive designed as a hollow shaft motor, which drive is supported by the bottom flange and a supporting flange, each arranged at a right angle to an axis of the motor a hollow shaft of the motor being supported by structure, so that a linear extension of the hollow shaft (43) and of a driving shaft of the motor is only possible in the direction away from the bottom flange.

8. Apparatus according to claim 1, further comprising an attachment (17) adapted to be flanged to a bottom of the container, the attachment having an inlet pipe surrounding the first substance feed inlet and positioned above the rotor/stator system, the attachment including an outlet socket (69) and a return line having a shut-off device branch off, said return line returning into the container.

9. Apparatus according to claim 8, wherein the return line (Z) is installed at least partly outside the container and is adapted to be heated or cooled.

10. Apparatus according to claim 1, further comprising at least one feeding device provided in a zone above the rotor.

11. Apparatus of claim 10, wherein the feeding device is an agitator attached to the rotor.

12. Apparatus according to claim 8, wherein the return line enters the container at a level below a level of product found in the container.

13. Apparatus according to claim 8, wherein the return line is adapted to be heated or cooled.

14. Apparatus according to claim 1, wherein the outlet channel extends from a hub of the rotor outwardly.

* * * * *